United States Patent [19]

Kauffman et al.

[11] 3,981,261

[45] Sept. 21, 1976

[54] BOAT DOCKING DEVICE

[76] Inventors: Andrew G. Kauffman, 212 Heather Road, Upper Darby, Pa. 19082; James D. Michelson, 17 Scarlet Ave., Greenridge, Pa. 19014

[22] Filed: Aug. 18, 1975

[21] Appl. No.: 605,590

[52] U.S. Cl. ..... 114/230
[51] Int. Cl.[2] ..... B63B 21/00
[58] Field of Search ..... 114/230

[56] References Cited

UNITED STATES PATENTS

| | | | |
|---|---|---|---|
| 2,456,839 | 12/1948 | Princell | 114/230 |
| 3,142,284 | 7/1964 | Kauffman | 114/230 |
| 3,373,714 | 3/1968 | Hart | 114/230 |

*Primary Examiner*—Trygve M. Blix
*Assistant Examiner*—Gregory W. O'Connor
*Attorney, Agent, or Firm*—Robert K. Youtie

[57] ABSTRACT

A boat docking device including a hub and a pair of arms outstanding from the hub and movable toward and away from each other, one arm being permanently swingably attached to a dock and the other removably swingably attached to the dock, the hub including a bolt or shackle extensible through and withdrawable from the bow eye of a boat when the arms are moved away from and toward each other, respectively.

9 Claims, 5 Drawing Figures

BOAT DOCKING DEVICE

BACKGROUND OF THE INVENTION

In the past there have been provided boat mooring devices of similar overall structure, for instance that disclosed in prior U.S. Pat. No. 3,142,284 to Kauffman. However, such prior art devices, while advantageous in use, were subject to certain difficulties, including mechanical complexity and high manufacturing costs, inability to adequately protect boats from high shock forces, and lack of versatility in mounting under widely different conditions of use.

SUMMARY OF THE INVENTION

It is, therefore, an important object of the present invention to provide a boat docking device of the type described which is greatly simplified in structure and number of parts, for enhanced durability and reliability throughout a long useful life, which effects substantial economies in manufacture for a reasonable sale price, greatly simplifies the ease of installation and operation under widely varying environmental and operating conditions, is adapted to effectively absorb shock loads for protecting both the boat and dock.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
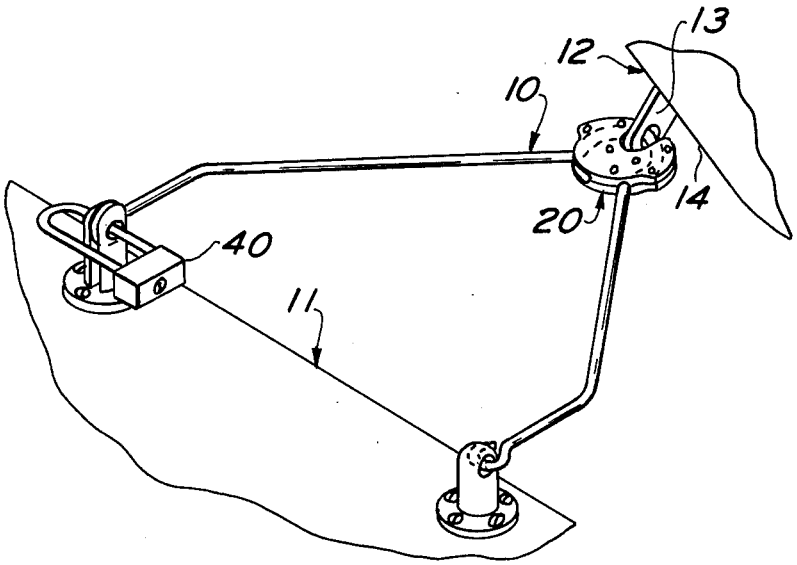
FIG. 1 is a perspective view showing the docking device of the present invention in operative association with a boat and dock for securing the former to the latter.

Referring now more particularly to the drawings, and specifically to FIG. 1 thereof, a boat docking device of the present invention is there generally designated 10 and shown in its operative boat holding, docking or mooring relation with respect to a dock or float 11 and a boat or water vehicle 12. It is appreciated that the docking structure 10 of the present invention may be employed in association with fixed docks, bulkheads, piers or the like, in addition to the illustrated floating docks or floats, the latter being shown for purposes of illustration and without limiting intent. Also, while the moored device or boat 12 is shown as having a bow eye or fitting 13 projecting from the stem 14 of the boat, it is appreciated that other water vehicles may be moored or docked by the instant device utilizing other arrangements of boat fittings, as required by the circumstances.

Referring now more specifically to the boat docking device 10, it will be seen that the device includes a hub 20 of generally plate- of disc-like configuration and provided with an inwardly extending, through cut-out, notch or opening 21 (see FIG. 2) for removably receiving the apertured boat fitting or bow eye 13. As will appear more fully hereinafter, a bolt, shackle or pin 22 is carried by the hub 20 for extensile movement across the cut-out or opening 21 and retractile movement out of the cut-out for removable insertion through the boat fitting 13.

A pair of elongate elements or arms 23 and 24 project generally radially from the hub 20, generally coplanar with the hub and each other, remote from the cut-out 21. The arms 23 and 24 may advantageously be fabricated of rod stock, for economy in fabrication and suitable elastic resilience under stress, the arm 23 being fixed at one end to the hub 20 and having its other end provided with a loop or eye 25, generally coplanar with the arms 23 and 24, or at least having its axis in a plane normal to the plane of arms 23 and 24.

Figure 2:
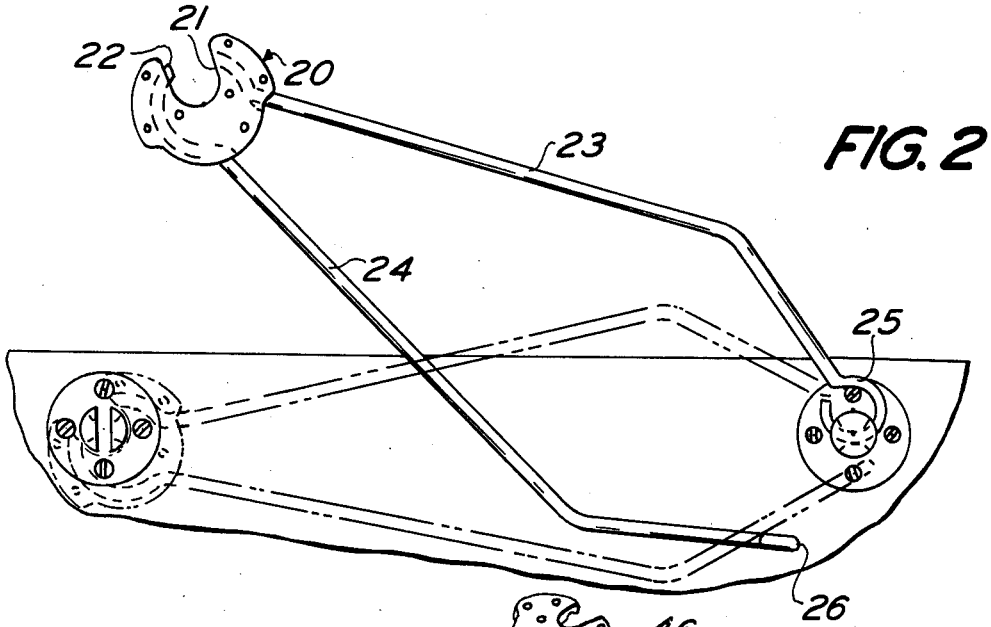
FIG. 2 is a plan view showing a boat docking device of the present invention in its inoperative condition apart from a boat, a storage condition being shown in phantom.
Figure 4:
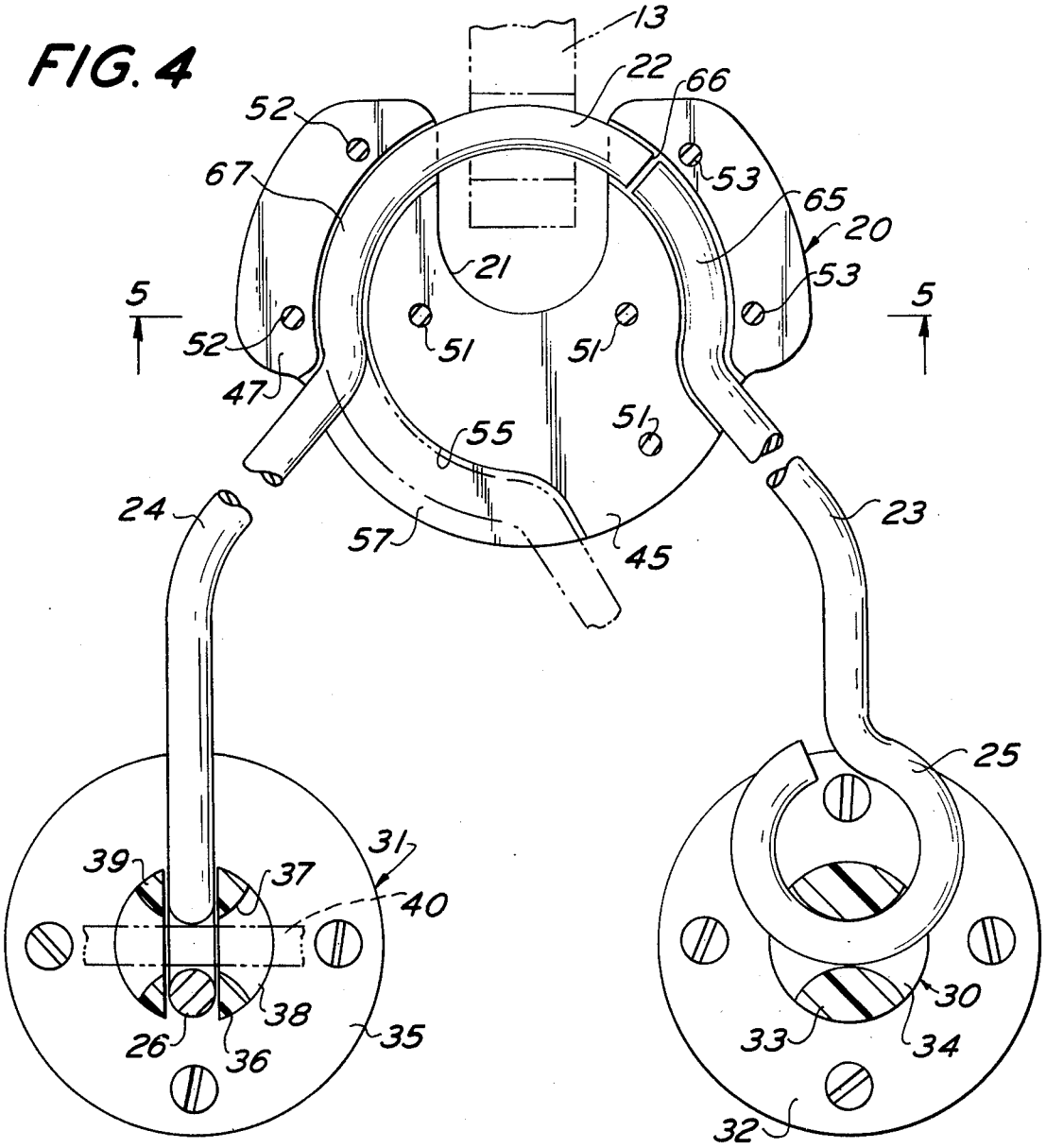
FIG. 4 is an enlarged generally horizontal sectional view broken away to conserve drawing space, and illustrating an alternate position in dot-and-dash outline.

The other arm 24 is shiftably mounted by the hub 20 for swinging movement relative to the hub and toward and away from the relatively fixed arm 23, as between the positions of FIGS. 1 and 2, or as illustrated in solid outline and phantom position in FIG. 4. The swingable or shiftable arm 24 has its distal or outer end remote from hub 20 provided with a loop or eye 26, say integrally formed from the rod stock of arm 24, with the loop 26 having its axis in a plane parallel to the plane of arms 23 and 24, or lying in a plane normal to the plane of the arms.

The boat docking device includes mounting means constituting a pair of eye members or pad eyes 30 and 31, adapted for suitable affixation to the dock or pier 11 in spaced aligned relation with respect to each other. In particular, the eye member or pad eye 30 includes a base plate or pad 32 suitably affixed to the dock 11, and a post or stud 33 upstanding from the pad or base, being rigidly secured to the latter by any suitable means, and provided at its outer end with a through opening, hole or eye 34.

The eye member or pad eye 31 is similarly constituted of a base or pad 35 adapted for affixation to the dock 11, and an outstanding stud or post 36 projecting rigidly from the pad and having at its outer end a through opening, hole or eye 37. In addition, the eye member 31 has its post or stud 36 longitudinally separated or bifurcated to define a pair of outstanding legs 38 and 39, say in the nature of a clevis.

In their fixed relationship relative to the dock 11 and to each other, the eye members 30 and 31 have their eyes or through openings 34 and 37 in substantial alignment with each other. The loop or eye 25 of arm 23 extends freely through the eye 34 of eye member 30 so that the arm 23 is connected to the eye member 30 for swinging movement of the arm about the axis of eye opening 34.

In the operative condition of FIGS. 1 and 4, it is seen that the loop or eye 26 on the end of arm 24 is removably insertable into the space between stud legs 38 and 39 of eye member 31. In this inserted condition the eye 26 is adapted for alignment with the eye opening 37, for the removable insertion through the aligned eyes 37 and 26 of a suitable shackle, pin or padlock, as at 40.

By the pin or padlock 40, the arm 24 is swingable about the aligned axes of eye members 30 and 31, so that the arms 23 and 24, together with the hub 20 are all swingable as a unit about the aligned eye member axis.

Figure 3:
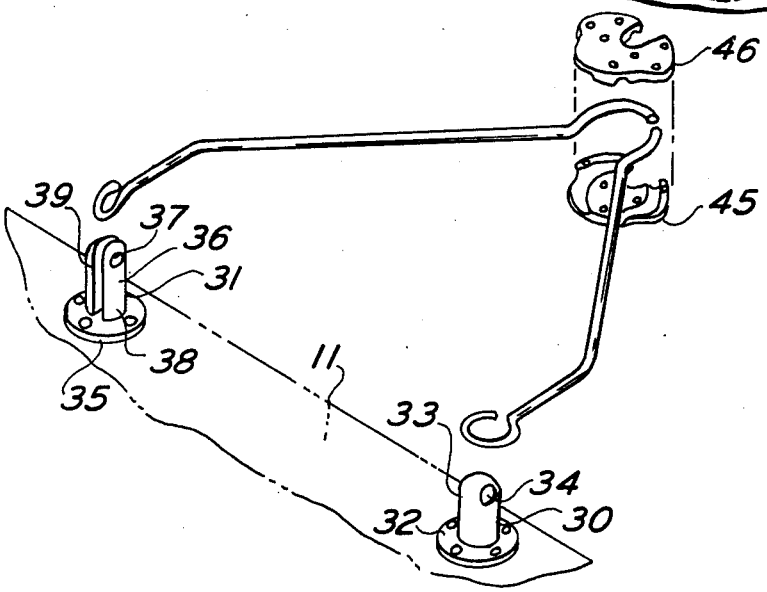
FIG. 3 is an exploded perspective view similar to FIG. 1.
Figure 5:
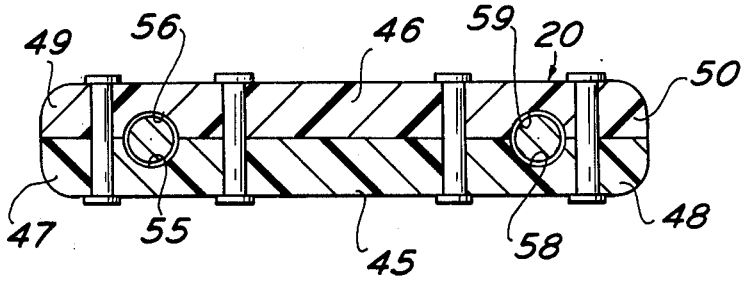
FIG. 5 is a transverse sectional view taken generally along the line 5—5 of FIG. 4.

Considering the hub 20 now in greater detail, it is best seen in FIGS. 3, 4 and 5 as being composed of a pair of facing, complementary lower and upper hub elements 45 and 46, generally of a congruent outline configuration which may be essentially circular, and formed with superposed notches defining the cut-out 21. On opposite sides of the cut-out 21, the hub elements 45 and 46 are formed with radial extensions or wings, as at 47 and 48 on the lower hub element and 49 and 50 on the upper hub element. The hub elements 45 and 46 are secured together in facing relation with each other by a plurality of fasteners, such as rivets 51 extending through the central superposed regions of the hub elements, and rivets 52 and 53 extending through overlying wing portions 47, 49 and 48, 50.

The inner or facing surfaces of the complementary hub elements 45 and 46 are formed with a pair of facing grooves 55 and 56 of generally semicircular extent approximately concentric with the hub extending from one side of the cut-out 21 approximately 180° to a location opposite the cut-out. The facing grooves 55 and 56 thus define a generally semicircular passageway; and a slot 57 opens generally radially outwardly from the passageway through approximately a quadrant or 90° located remote from the cut-out 21.

On the other side of the cut-out 21, generally concentric with the hub 20, the hub elements 45 and 46 are formed on their facing surfaces with additional facing grooves 58 and 59 extending arcuately, generally concentric with the hub through a sector of approximately 90°. The complementary, facing grooves 58 and 59 thus define an elongate passageway generally concentric with the passageway 55, 56, the former passageway opening into one side of the cut-out 21 opposite to and in spaced facing relation with the opening of the latter passageway into the cut-out 21. Remote from the cut-out 21, the passageway 58, 59 opens generally radially outwardly, as at 60.

Further referring to FIGS. 4 and 5, it will be seen that the arm 23 has its inner end portion 55, associated with the hub 20, of an arcuate configuration conformably received in the passageway 58, 59 and rigidly anchored therein, the arm extending through the passageway portion 60 generally radially outwardly from the hub. The terminal end 66 of the anchored end portion 55 is seen as being located interiorly within and spaced from the open end of passageway 58, 59.

The arm 24 has its inner end portion 57, associated with the hub 20, of an arcuate configuration and longitudinally, slidably received in passageway 55, 56, with the arm 24 extending generally radially from the hub through the slot 57. Thus, the arcuate arm end portion 67 is slidable in receiving passageway 55, 56 to shift the arm 24 for swinging movement thereof in the plane of and toward and away from the relatively fixed arm 23. The hereinbefore mentioned shackle, bolt or pin 22 is defined by an integral extension of the arm end portion 67 and is mounted for its previously described extensile and retractile motion by the swinging motion of arm 24. Further, the free end of bolt or pin 22 is engageable into and withdrawable from the passageway 58, 59 at its end opening into the cut-out 21.

In the operative condition of use, as shown in FIG. 1 and in solid lines in FIG. 4, it will be seen that the bolt or pin 22 extends through the boat fitting or bow eye 13 and positively shackles the docking device 10 to the boat, while permitting up and down swinging movement of the hub 20 about the axis of eye members 30 and 31 to accommodate wave action, and the like. Shock stresses are readily absorbed by the resilience of arms 23 and 24. In this condition, the boat 12 is suitably moored in a safe and secure manner to the dock 11, while accommodating to water movement by wave action, tides, wind and other. Also, the boat 12 is suitably held for ease of boarding by mere stepping between the boat and dock.

To disconnect the docking device, as for "casting off", it is only necessary to remove the shackle, pin or padlock 40, which releases the eye 26 for withdrawal from between the eye member legs 38 and 39. This is conveniently accomplished by reason of the inherent resilience and tolerances of the parts. The arm 24 may then be swung toward arm 23 which retracts bolt 22 into passageway 55, 56 of hub 20 to disconnect the hub from the boat fitting 13. The boat docking device 10 may then be swung inwardly, through the solid line position shown in FIG. 2 generally about the axis of eye 25 to the phantom position shown in the latter figure. It will there be seen that the stud or post 36 of eye member 31 is received in and passes through cut-out 21 of hub 20 to effectively position the device on the dock 11 without obstructing or presenting a hazard to traffic. In this nonuse or storage condition, the phantom position of FIG. 2, the padlock 40 may be reinserted through eye 37, if desired, to prevent removal of the device from its storage position. Of course, the mooring or docking procedure is merely the reverse of that described above.

In the non-use or self-storing position, the swingable or shiftable arm 24 is engageable beneath the fixed arm 23 and outward, behind or seaward of the stud 30, so as to be positively retained in this position unless the hub 20 is removed from stud or post 36. Of course, a padlock through stud eye 37 will preclude removal from the above described position.

From the foregoing it is seen that a boat docking device is provided which is extremely simple in construction, effects substantial economies in manufacture, distribution, installation and use, effectively protects a moored boat from damage under extreme weather conditions, requires no alteration or additions to conventional boats, and is extremely versatile for use under a wide variety of mooring conditions. For example, in addition to being unsable with fixed docks and bulkheads, as well as floating docks, it will be appreciated that the eye members 30 and 31 may, with equal facility, be mounted on a vertical surface, if desired, and may be reversed or inverted as for the specific docking environment or personal preference.

Although the present invention has been described in some detail by way of illustration and example for purposes of clarity of understanding, it is understood that certain changes and modifications may be made within the spirit of the invention.

What is claimed is:

1. A boat docking device comprising a hub having a cut-out for receiving a boat fitting, a fixed arm having one end fixedly connected to said hub and having its other end extending outwardly therefrom, a shiftable arm having one end shiftably connected to said hub and having its other end extending outwardly therefrom and movable toward and away from said fixed arm, a bolt connected to said shiftable arm for extensile and retractile movement therewith into and out of said cut-out upon respective movement of said shiftable arm away from and toward said fixed arm for extension through and withdrawal from the boat fitting, a pair of eye members adapted for spaced affixation to a dock and each having an aperture fixed in substantially horizontal axial alignment with each other, a first loop on the other end of one of said arms extending swingably through one of said eye member apertures, and a second loop on the other end of the other of said arms for movement therewith into and out of alignment with the other of said eye member apertures when said arms are in respective positions away from and toward each other, whereby a shackle is removably engageable through said aligned second loop and other eye member to removably mount said arms and hub for swinging movement about the axis of said eye member apertures.

2. A boat docking device according to claim 1, said eye members each comprising a pad for rigid affixation to a dock, and a stud outstanding rigidly from said pad and provided with a respective one of said apertures.

3. A boat docking device according to claim 2, one of said studs being bifurcated to receive said second loop.

4. A boat docking device according to claim 2, said hub being swingable with said fixed arm about the other of said studs to receive said one stud in said cut-out when said second loop is free to define a self-storing position.

5. A boat docking device according to claim 4, said shiftable arm being engageable beneath said fixed arm and behind said other stud for retention thereby in said self-storing position.

6. A boat docking device according to claim 1, said arms each being fabricated of an integral length of stiff resilient rod stock for elastic yieldability under stress.

7. A boat docking device according to claim 6, said bolt comprising an integral extension of the rod stock of said shiftable arm.

8. A boat docking device according to claim 1, said hub having a pair of generally arcuate cavities of common center of curvature and located on opposite sides of and opening into said cut-out, said bolt being arcuate and shiftable in one of said cavities for extensile movement across said cut-out and into the other of said cavities and retractile movement therefrom into said one cavity.

9. A boat docking device according to claim 8, said arms each being fabricated of an integral length of stiff resilient rod stock for elastic yieldability under stress, and said bolt comprising an integral extension of the rod stock of said shiftable arm.

* * * * *